United States Patent [19]

Helms

[11] 4,351,436

[45] Sep. 28, 1982

[54] COMPOSITE CARDED DISPLAY PACKAGE

[75] Inventor: Charles R. Helms, Malvern, Pa.

[73] Assignee: Container Corporation of America, Chicago, Ill.

[21] Appl. No.: 261,499

[22] Filed: May 7, 1981

[51] Int. Cl.[3] ..... B65B 15/00; B65D 73/00

[52] U.S. Cl. ..... 206/477; 206/0.81; 206/0.82; 206/45.14

[58] Field of Search ..... 206/0.81, 0.82, 806, 206/45.14, 45.28, 45.31, 211, 277, 461, 462, 466, 378, 379, 445, 477, 535, 484, 489, 363, 495, 478; 229/3.1

[56] References Cited

U.S. PATENT DOCUMENTS

| | | | |
|---|---|---|---|
| 2,401,615 | 11/1943 | Chittum | 206/45.14 |
| 2,866,544 | 12/1958 | Klein et al. | 206/489 |
| 3,095,966 | 4/1963 | Pfohl | 206/461 |
| 3,148,103 | 9/1964 | Gallagher | 206/445 |
| 3,263,891 | 8/1966 | Brugh, Jr. | 229/3.1 |
| 3,437,193 | 4/1969 | Freeman | 206/45.14 |
| 3,487,915 | 1/1970 | Scott | 206/461 |
| 3,592,337 | 7/1971 | Phillips, Jr. | 206/461 |
| 3,770,120 | 11/1973 | Hanson | 206/45.14 |
| 3,981,395 | 9/1976 | Dalgleish | 206/0.82 |

*Primary Examiner*—William Price
*Assistant Examiner*—Jimmy G. Foster
*Attorney, Agent, or Firm*—Richard W. Carpenter; Davis Chin

[57] ABSTRACT

A composite carded display package including a paperboard advertising panel having at one end thereof an integral, hollow, paperboard and plastic pocket member for holding a packaged article.

16 Claims, 8 Drawing Figures

COMPOSITE CARDED DISPLAY PACKAGE

BACKGROUND OF THE INVENTION

1. Field of the Invention

This invention relates generally to carded display packages, and more particularly to a composite carded display package which includes a generally flat advertising card member having formed integrally therewith a hollow pocket member formed of paperboard and molded plastic for holding an article to be displayed.

2. Description of the Prior Art

A state of the art search directed to the subject matter of this appliction uncovered the following patents: U.S. Pat. Nos. 2,866,544; 2,903,139; 2,990,082; 3,023,923; 3,127,698; 3,179,246; 3,275,274; 3,286,835; 3,322,269; 3,436,008; 3,459,359; 3,645,384; 3,657,855; 3,698,551; 3,770,120; 3,785,544; 3,908,827; 3,910,410; 4,029,202; 4,076,790; 4,092,201; 4,109,821.

None of the prior art patents uncovered in the search disclosed a composite and paperboard plastic carded display package similar to that of the present invention wherein a card member has a composite pocket member integrally formed with and extending from one end thereof for holding a packaged article.

SUMMARY OF THE INVENTION

It is an object of the invention to provide an improved visual carded package adapted to stand on a shelf with similar packages or to be suspended from a display rack.

Another object of the invention is to provide an improved visual carded display package formed of paperboard and plastic by an insert molding process.

A more specific object of the invention is to provide, in a display package of the type described, an arrangement which includes a generally flat paperboard display or advertising card member having formed integrally at one end thereof a composite paperboard and plastic pocket member adapted to receive and retain a packaged article therein.

These and other objects of the invention will be apparent from an examination of the following description and drawings.

It will be understood that for purposes of clarity certain elements may have been intentionally omitted from certain views where they are believed to be illustrated to better advantage in other views.

DESCRIPTION OF THE PREFERRED EMBODIMENTS

Figure 1:
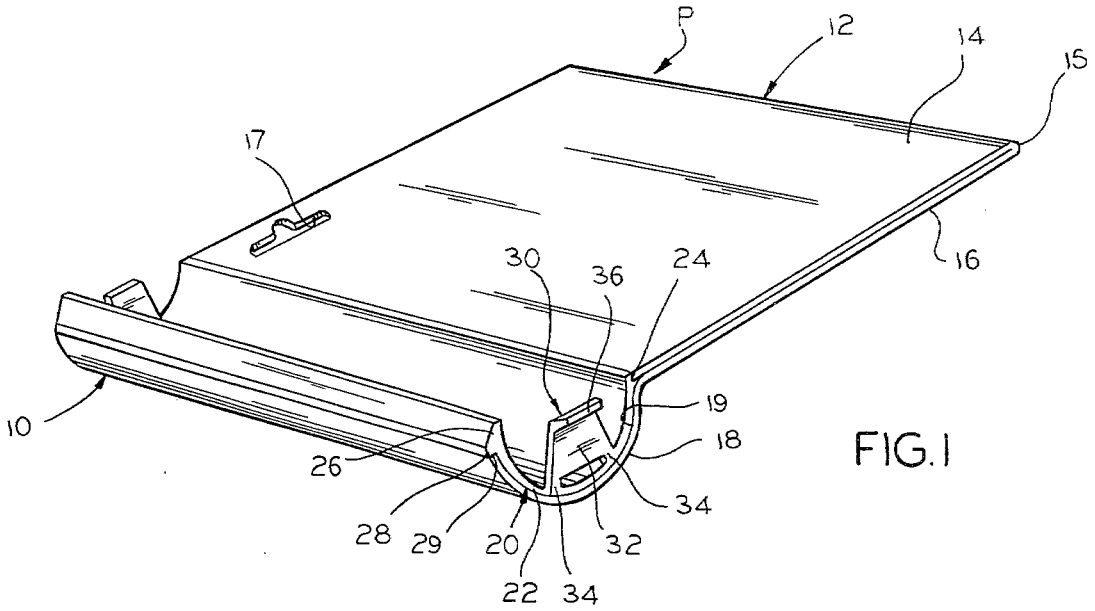
FIG. 1 is a perspective view of a composite carded display package embodying features of the invention.
Figure 2:
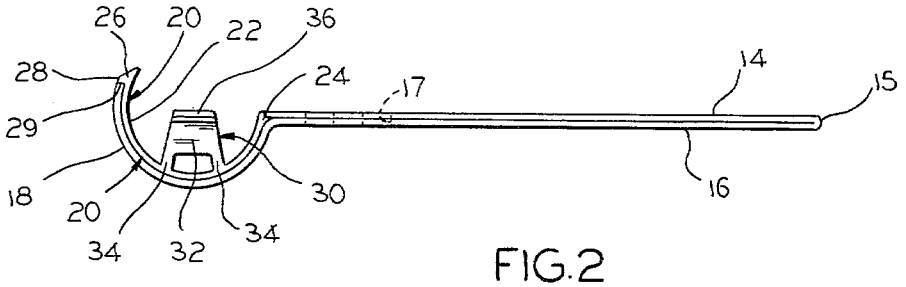
FIG. 2 is a side elevational view of the structure illustrated in FIG. 1.
Figure 4:
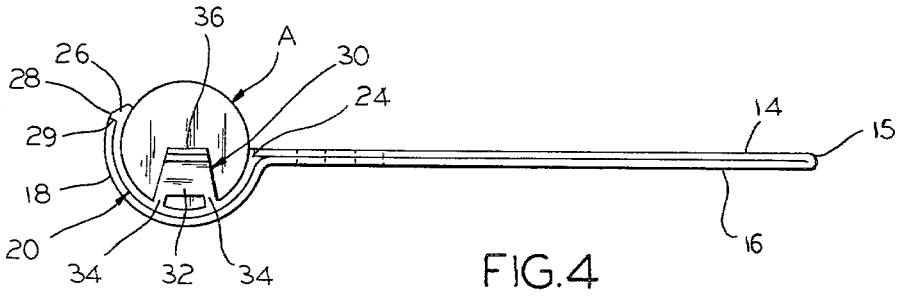

Referring now to the drawings for a better understanding of the invention, and particularly to FIGS. 1 and 4, it will be seen that the invention comprises a novel display package indicated generally at P which is adapted to hold and display a packaged article indicated generally at A.

As best seen in FIG. 1, display package P includes a hollow, article holding or pocket member, indicated generally at 10 which is formed integrally with and projects from a relatively flat advertising or card member 12.

Card member 12 may include a pair of relatively flat paperboard front and rear panels 14 and 16, respectively, which have corresponding rear edges foldably joined to each other along a fold line 15, and which are disposed in face-to-face relation and preferably secured to each other in any manner such as by gluing. In order to permit display package P to be suspended from a rack in a retail store for display purposes card member 12 may be provided with an opening 17 extending therethrough which is located in such a position as to permit the package to hang level when it is filled with a packaged article.

At its forward end rear panel 16 is provided with an integral extension 18 projecting therefrom which is generally semi-cylindrical in shape to define a channel 19.

Thus extension 18 of rear panel 16 serves as a shell in which to receive and be bonded to a similarly contoured liner 20 which is formed of molded plastic.

The general construction of this package is accomplished in the same manner as the article described in U.S. Pat. No. 3,397,814. In this type of construction the paperboard portion of the package is inserted into a mold, and then plastic is inserted to form the liner of the pocket member and at the same time bond the liner to the shell and to portions of the display card member of the package in order to form a composite package.

Still referring to FIG. 1, it will be seen that liner 20 includes a preferably cylindrically shaped body portion 22 having at its rear edge an integral anchor or wedge-shape portion 24 which extends between the adajcent edges of the card member front and rear panels 14 and 16. This is accomplished when the package is formed in a mold, as previously described, and helps secure and strengthen the relationship of the pocket member to the card member.

At its forward edge liner 20 is provided with an enlarged portion or head 26 having a shoulder or abutment 28 which presents a recess 29 for receiving the forward portion of shell 18 of the pocket member.

Figure 3:
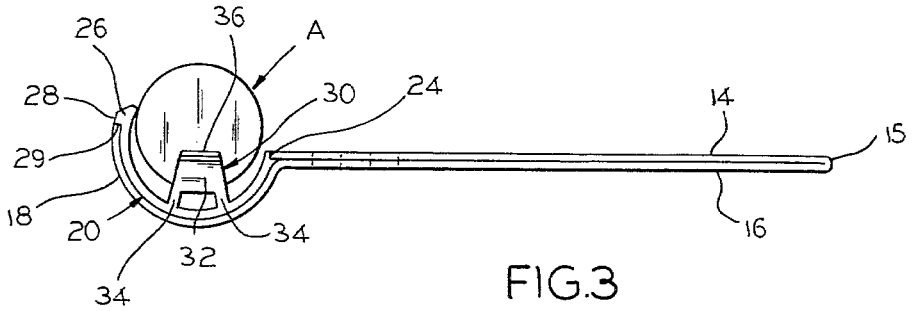
FIGS. 3 and 4 are views similar to FIG. 2, but illustrate the manner in which a portion of the structure is flexed to accommodate the insertion of article to be packaged therein.

In the embodiment illustrated in FIGS. 1 to 4 it will be noted that the pocket member 10 is generally semi-cylindrical in shape; although it must be understood that the pocket member can assume any one of many various shapes depending upon the shape of the article to be packaged. For illustrative purposes, it will be seen that when the pocket member does have a cylindrical shape, as illustrated in FIGS. 3 and 4, it is so formed that the liner 20 of the pocket member has a contour to match the contour of the article to be received therein. However, when the liner is formed initially the forward extremity or head 26 is spaced from the rear or anchor portion a distance which is less than the diameter of the article to be received, so that, in order to receive the article, the pocket member must be flexed outwardly. Thus, when the article is received there is a snug frictional engagement between the liner of the pocket member and the article packaged therein.

In order to prevent the accidental axial movement of the packaged article A out of the pocket member 12 there may be provided a pair of integral retaining elements 30 formed at opposite ends of the liner 20. The retaining elements 30 not only prevent the accidental movement of the article out of the pocket member, but they also make it more difficult to intentionally remove the article from the pocket member, because they block the ends of the pocket member. Each of the retaining elements 30 includes a body portion 32 having a pair of legs 34 extending from the lower corners thereof for attachment to the end edges of liner body 22. In order to provide access to the article and make it easier to move the article from the pocket member the retaining elements are provided with integral outwardly extending flanges 36 which may be easily broken off to provide access to the packaged article and permit it to be slipped out of the end of the pocket member. Thus, the package is, to some extent, tamper-proof, in that it is difficult to remove the article without the destroying the integrity of the package.

Now referring to FIGS. 5 through 8, it will be seen that modified forms of the invention are illustrated therein. In each case those portions of the structure corresponding to portions of structure of the previously described embodiment are indicated by the same or similar numerals.

Figure 5:
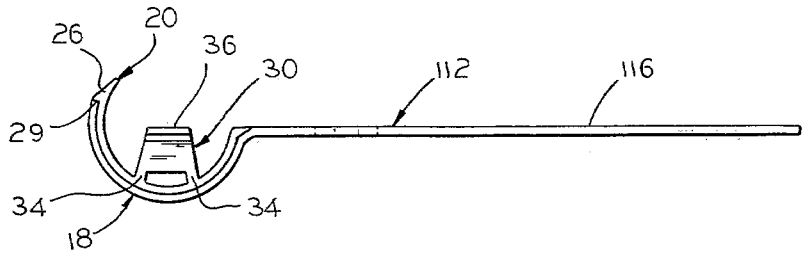
FIGS. 5 and 6 are similar to FIG. 2, but illustrate modified forms of the invention.

In FIG. 5 the embodiment is basically the same as that illustrated in FIGS. 1 through 4, except that the card member 112, instead of comprising a pair of panels in disposed face-to-face relation, comprises single panel 116 having an extension 18 which receives a liner 22 to form a pocket member in the same manner as that of the previously described embodiment.

Figure 6:
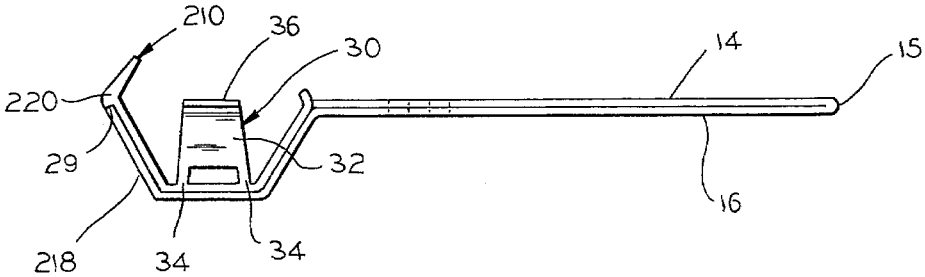

Referring now to FIG. 6, it will be seen that another slightly modified form of the invention is shown. Again the structure in this embodiment is similar to that of FIG. 1, except that the pocket member 210 is generally hexagonal in shape, rather than semi-cylindrical. The structure functions in the same manner as that of the previously described embodiment but is particularly suitable when the article to be packaged is hexagonal in shape rather than cylindrical. It is to be understood, of course, that if the article is octagonal or has any other shape, the pocket member may be contoured to fit the contour of the packaged article.

Figure 7:
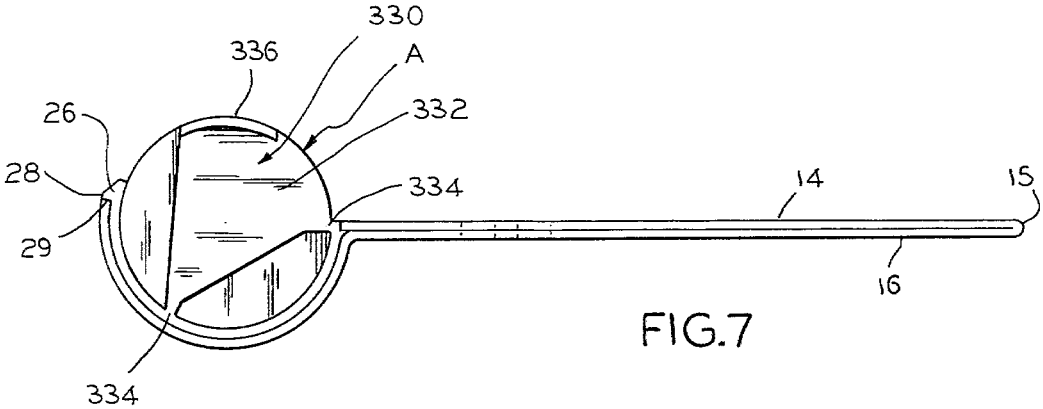
FIG. 7 is a view similar to FIG. 4, but illustrating yet another modification of the invention.
Figure 8:
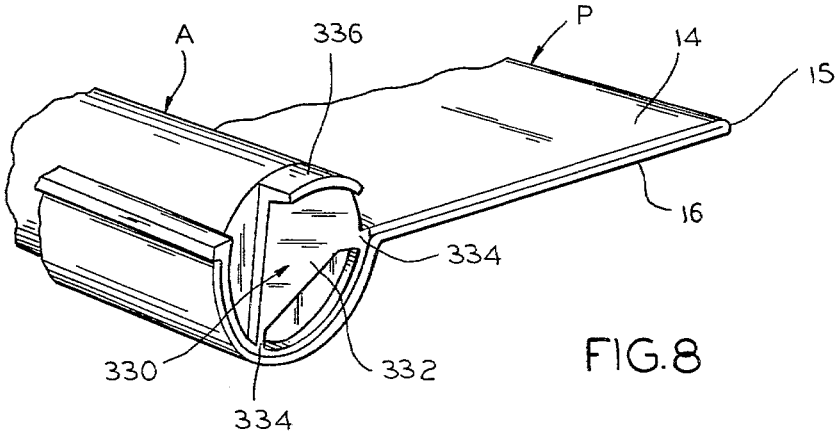
FIG. 8 is a fragmentary perspective view of the portion of the structure illustrated in FIG. 7.

Now turning to FIGS. 7 and 8 it will be seen that a slightly modified form of the invention is shown. In this embodiment the structure again is very similar to the structure illustrated in FIG. 1, except that the retaining elements 330 have been enlarged so as to have the same overall dimension as the diameter of the packaged article. Also the legs 344 are spaced slightly differently, with the rear leg joining the body 22 of the liner at the anchor or wedge portion 24 thereof. This embodiment of the invention functions in basically the same manner as that of the previously described embodiments.

It is to be understood that in each embodiment of the invention there is provided a novel composite paperboard and plastic visual carded display package that permits an article to be attractively displayed and yet is relatively tamper-proof because in most cases it is necessary to destroy the integrity of the package to have easy access to the packaged article.

What is claimed is:

1. In a composite paperboard and plastic carded display package, the combination of:

(a) a relatively thin, generally flat advertising card member, formed of paperboard, and, extending from one end thereof, a hollow pocket member for holding a packaged article;

(b) said pocket member including an outer paperboard shell element, formed integrally with and extending from said card member, and an inner plastic liner element bonded to said shell element;

(c) said linear element having a contour adapted to snugly engage and retain a packaged article therein.

2. A package according to claim 1, wherein said card member includes a pair of parallel front and rear panels disposed in face-to-face relation with each other.

3. A package according to claim 2, wherein said rear panel is foldably joined at one edge to a corresponding edge of said front panel.

4. A package according to claim 2, wherein said rear panel is formed integrally with said pocket member shell element.

5. A package according to claim 1, wherein said pocket member is generally trough-shaped.

6. A package according to claim 1, wherein said pocket member is generally cylindrically shaped.

7. A package according to claim 1, wherein said pocket member is generally hexagonal in cross section.

8. A package according to claim 1, wherein said card and pocket members are formed simultaneously by insert injection molding.

9. A package according to claim 1, wherein said pocket member liner element includes an enlarged portion at the rear thereof which is bonded to said card member.

10. A package according to claim 1, wherein said card member includes a pair of panels disposed in face-to-face relation, and wherein said pocket member liner element includes at the rear edge thereof an anchor section bonded between adjacent marginal portions of said card member panels.

11. A package according to claim 1, wherein said pocket member includes means for preventing the accidental removal of a packaged article.

12. A package according to claim 1, wherein said pocket member liner element includes retaining structure engageable with an article packaged therein to prevent said article from accidentally coming out of said pocket member.

13. A package according to claim 1, wherein said pocket member liner element is generally trough-shaped and includes a pair of integral retaining structures at opposite ends thereof for preventing the axial movement of a packaged article out of said pocket member.

14. A package according to claim 1, wherein said pocket member liner element includes detachable retaining structure means for retaining a packaged article in said pocket member.

15. A package according to claim 1, wherein said pocket member is flexible and adapted to be flexed outwardly to receive a packaged article.

16. A package according to claim 1, wherein said pocket member liner element is trough-shaped to hold a packaged article and includes integral retaining structure adapted to prevent removal of the article from the pocket member without destruction of said retaining structure.

* * * * *